United States Patent [19]

Stahl

[11] 4,109,681

[45] Aug. 29, 1978

[54] HOISTING CRANE FOR BUILDING PURPOSES

[75] Inventor: John Edvard Lennart Stahl, Bromma, Sweden

[73] Assignee: Tornborg & Lundberg AB, Bristagatan, Sweden

[21] Appl. No.: 669,080

[22] Filed: Mar. 22, 1976

Related U.S. Application Data

[63] Continuation of Ser. No. 467,361, May 6, 1974, abandoned.

[51] Int. Cl.[2] ..... B67D 5/00

[52] U.S. Cl. ..... 137/615; 212/8 A; 214/763

[58] Field of Search ..... 137/615; 212/8 A; 214/763

[56] References Cited

U.S. PATENT DOCUMENTS

| | | | |
|---|---|---|---|
| 3,085,593 | 4/1963 | Sorensen | 137/615 |
| 3,651,832 | 3/1972 | Meyer | 137/615 |
| 3,707,990 | 1/1973 | Schaible et al. | 137/615 |

FOREIGN PATENT DOCUMENTS

| | | | |
|---|---|---|---|
| 1,953,108 | 10/1969 | Fed. Rep. of Germany | 137/615 |
| 391,368 | 10/1931 | United Kingdom | 212/8 A |

*Primary Examiner*—William R. Cline
*Assistant Examiner*—H. Jay Spiegel
*Attorney, Agent, or Firm*—Fred Philpitt

[57] ABSTRACT

A hoisting crane is of the type comprising a tower and at the top region thereof one inner and one outer jib section which are pivotably mounted. The jib sections have roughly the same length and are by a means slewed relative to the tower, whereby the outer end of the outer jib section — which carries a hoist controlled lifting hook — always takes substantially the same level. A pipe for pumping of concrete to a portioning means at the outer end of the outer jib section is attached to the tower and the two jib sections. Rotary couplings are provided coaxial with the pivot axes.

1 Claim, 1 Drawing Figure

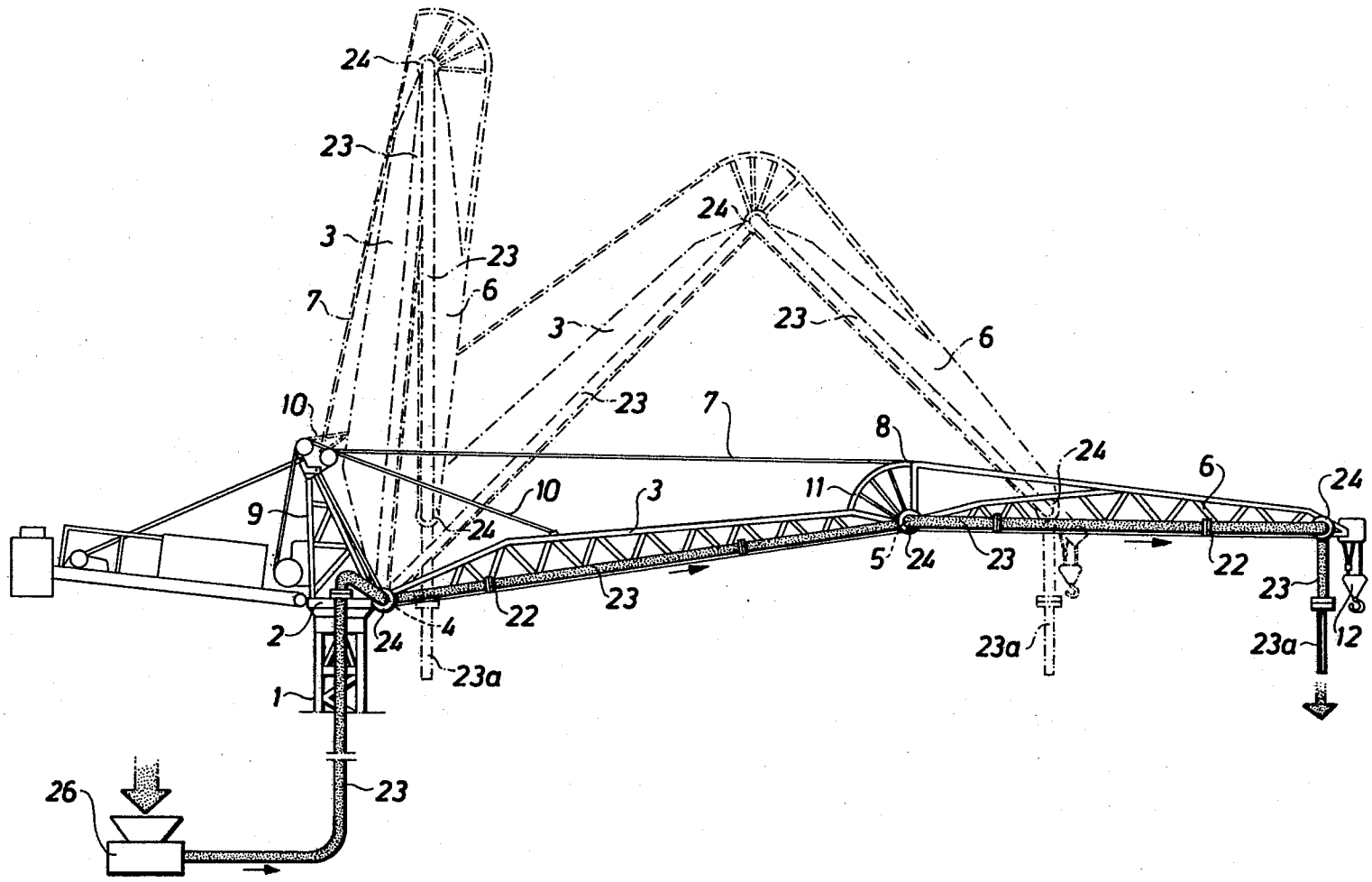
24
12
23
23a
22
6
24
23
23a
6
24
8
5
11
23
24
7
3
23
23
3
10
22
23
6
24
4
23a
24
23
3
7
10
9
2
1
23
26

HOISTING CRANE FOR BUILDING PURPOSES

This is a continuation of application Ser. No. 467,361, filed May 6, 1974, now abandoned.

This invention relates to a hoisting crane for building purposes, comprising a tower, an inner jib section pivotably mounted in the region of the top of the tower, an outer jib section having roughly the same length as the inner jib section and being pivotably mounted at the outer end of the inner jib section, a bow-shaped guide means for a control rope running between the inner end of the outer jib section and the borach of the tower, said control rope being adapted to steer the angular position of the outer jib section relative to the inner jib section in correspondence to the slewing angle of the inner jib section relative to the tower so that the outer end of the outer jib section takes substantially the same level independent of said slewing angle, means for slewing the inner jib section between a substantially horizontal or slightly upwards directed position, in which the outer jib section takes a substantially horizontal position to an almost vertical upward-directed position in which the outer jib section takes a substantially vertical downward-directed position with a hoist-controlled lifting hook for the load at the outer end thereof in a position near the tower.

A hoisting-crane of this general type is disclosed in Swedish Pat. No. 204,056 issued on Nov. 4, 1965.

The possibilities of use for a crane of this kind has prooved to be substantially increased if according to the present invention the tower and the inner and outer jib sections are provided with pipe means for pumping of concrete to a portioning means at the outer end of the outer jib section.

There are previously known different arrangement for pumping of concrete. Illustrative of the state of the art are the following patents:

French Pat. No. 1,521,859 issued on Mar. 11, 1968
UK Pat. No. 24.023 issued on Oct. 24, 1912
Swiss Pat. No. 444,030 issued on Sept. 15, 1967
German Pat. No. 424,922 issued on July 17, 1923

However, none of these previous arrangements has the particular advantage of present invention that the work of portioning the concrete becomes greatly simpler and safer in consequence of the circumstance that the outer end of the outer jib section is always located at roughly the same level regardless of the distance from the crane tower. In addition to be being used for portioning of concrete the crane can also be utilized without inconvenience for other tasks normally encountered on a building site. A substantial saving in cost can be achieved in that the need of a special portioning device which can only be utilized for this purpose is eliminated.

The line is provided with a number of rotary couplings acting around horizontal axes at the inner and outer ends of the inner and outer jib sections, respectively.

An example of the invention is known on the accompanying schematic drawing.

In the drawing, reference numeral 1 designates a tower which, for example, can be anchored in a house building or the like and be raised upwards as the house structure increases in height. Alternatively, the tower can stand stationarily outside the building or be railbound. A slewing frame for the jib system of the crane is designated 2. In the illustrated embodiment it is not but it can be mounted rotatably in the horizontal plane on the tower 1. Instead in the embodiment shown the tower is at its bottom portion mounted rotatably around its longitudinal axis (bottom portion of tower not shown).

The jib system consists of an inner section 3 which is pivotably mounted in the slewing frame 2 around a horizontal shaft 4. Pivotably mounted on a horizontal shaft 5 at the outer end of the jib section 3 is an outer jib section 6 controlled by a rope 7 which at 8 is attached to the jib section 6 at a distance above the shaft 5 and at the other end to an upper tower broach 9 on the slewing frame 2.

The side of the turret broach facing towards the mounting shaft 4 for the inner jib section 3 slopes upwards and rearwards. The jib section 3 can, from an outer position — shown in the drawing with unbroken lines — in which it forms a large angle with jib section 6 be swung upwards by means of an attached system of draglines 10 or the like, which are carried upwards to the upper part of the turret broach 9 and on to a motor-driven cable machinery or the like on the slewing frame 2 or the turret broach 9.

When the inner jib section 3 is swung upwards, the control cable passes along a bow-shaped guide 11 attached to the outer jib section 6, while the same jib section 6, pivoting around shaft 5, is dropped inwards towards the inner jib section 3.

In an inner end position, the jib section 3 can stand vertically or practically vertical with the jib section 6 hanging downwards, for example as shown with broken lines in the drawing. A load suspended in a hoist-controlled lifting hook 12 is then positioned close to the tower 1. If the jib sections 3, 6 are to be swung outwards, the dragline system 10 is lengthened.

The tower 1, the inner jib section 3 and the outer jib section 6 are provided with means 22 for attachment of a piping 23 which allows pumping of concrete from a concrete pump 26, located either at a convenient position in relation to the crane or mounted on the crane, to a portioning means **23*a* located at the outer end of the outer jib section 6**.

The piping 23 is provided with a number of rotary couplings 24 coaxial with the pivot axes of the crane, i.e. one or preferably two such couplings between the tower 1 and the inner jib section 3 and one or preferably two couplings between the inner 3 and the outer jib section 6. In addition preferably only one rotary coupling 24 is provided at the outer end of the outer jib section. The portioning means **23*a*, which possibly can simply consist of the end of piping 23, will move along a horizontal path regardless of the overhang of the jib system, whereby the work of portioning out the concrete is facilitated. There is, thus, no risk that the outer portioning means 23*a*** will dig itself down into the casting mould or, alternatively, that the concrete will be discharged from all too great a height above the mould. In particular, portioning of concrete becomes possible in a pattern over an area with the portioning means always at the same height, which has proved to be a great advantage in relation to other portioning methods. Additionally, accident risks are greatly reduced and safety is greatly improved in connection with concrete portioning in relation to other systems utilized hitherto.

In a modified embodiment the slewing frame 2 is rotatable relative to the tower 1. Then the pipe 23 has a rotary coupling (not shown) acting around a vertical axis in the upper part of the tower, i.e. in the region of the slewing frame.

What is claimed is:

1. A hoisting crane for building purposes, comprising (a) a tower, (b) an inner jib section pivotably mounted in the region of the top of the tower, (c) an outer jib section having roughly the same length as the inner jib section and being pivotably mounted at the outer end of the inner jib section, (d) a bow-shaped guide means for a control rope running between the inner end of the outer jib section and the broach of the tower, said control rope being adapted to steer the angular position of the outer jib section relative to the inner jib section in correspondence to the slewing angle of the inner jib section relative to the tower so that the outer end of the outer jib section takes substantially the same level independent of said slewing angle, (e) means for slewing the inner jib section between a substantially horizontal or slightly upwards directed position, in which the outer jib section takes a substantially horizontal position to an almost vertical upward-directed position in which the outer jib section takes a substantially vertical downward-directed position, (f) pipe means on said tower and said inner and outer jib sections for the pumping of concrete to a portioning means at the outer end of the outer jib section, said pipe means being provided with rotary couplings acting around horizontal axis at the pivot axis of the inner and outer ends of the inner and outer jib sections, respectively, and a rotary coupling acting around a vertical axis in the upper part of the tower, and (g) a hoist controlled lifting hook mounted adjacent the outer end of said outer jib.

* * * * *